US009108095B1

(12) United States Patent
Gamble

(10) Patent No.: US 9,108,095 B1
(45) Date of Patent: Aug. 18, 2015

(54) GAME PUCK WITH REPLACEABLE RUNNERS

(71) Applicant: Verbero Sports Inc., Modesto, CA (US)

(72) Inventor: Charles J. Gamble, Modesto, CA (US)

(73) Assignee: Verbero Sports, Inc., Modesto, CA (US)

( * ) Notice: Subject to any disclaimer, the term of this patent is extended or adjusted under 35 U.S.C. 154(b) by 0 days.

(21) Appl. No.: 14/333,326

(22) Filed: Jul. 16, 2014

(51) Int. Cl.
*A63B 67/14* (2006.01)

(52) U.S. Cl.
CPC ..... *A63B 67/14* (2013.01)

(58) Field of Classification Search
CPC ..... A63B 67/14; A63B 71/02; A63B 2243/0041; A63B 2243/0045
USPC ..... 473/588, 589
See application file for complete search history.

(56) References Cited

U.S. PATENT DOCUMENTS

| | | | | | |
|---|---|---|---|---|---|
| 5,275,410 | A * | 1/1994 | Bellehumeur et al. | ..... | 473/588 |
| 5,465,966 | A * | 11/1995 | La Savio | ..... | 473/588 |
| 5,482,274 | A * | 1/1996 | Bellehumeur | ..... | 473/588 |
| 5,697,858 | A * | 12/1997 | Lekavich | ..... | 473/588 |
| 5,816,965 | A * | 10/1998 | Kotler | ..... | 473/588 |
| 5,855,528 | A * | 1/1999 | Aiello et al. | ..... | 473/588 |
| 6,010,418 | A * | 1/2000 | Lekavich | ..... | 473/588 |
| 6,126,561 | A * | 10/2000 | Mark | ..... | 473/588 |
| 6,152,842 | A * | 11/2000 | Licursi | ..... | 473/588 |
| 6,248,034 | B1 * | 6/2001 | Voloshen | ..... | 473/588 |
| 6,592,476 | B1 * | 7/2003 | Bellehumeur et al. | ..... | 473/588 |
| 6,893,367 | B1 * | 5/2005 | Nudo | ..... | 473/588 |
| 2005/0209030 | A1 * | 9/2005 | Verrengia | ..... | 473/588 |

* cited by examiner

*Primary Examiner* — Raleigh W Chiu
(74) *Attorney, Agent, or Firm* — Thomas M. Freiburger

(57) ABSTRACT

A hockey puck or game puck designed for non-ice street and court play has friction-reducing runners that engage the playing surface, the runners being replaceable without need for tools. The runners, which can have friction characteristics similar to that of traditional non-ice pucks, can easily be replaced by hand when worn or broken, using the same puck body. Multiple sets of runners with different sizes and friction characteristics preferably are provided, the runners being interchangeable as desired. Replacement runners are inexpensive and allow the puck body to be used over a long period of time.

7 Claims, 5 Drawing Sheets

GAME PUCK WITH REPLACEABLE RUNNERS

BACKGROUND OF THE INVENTION

This invention concerns game pucks, particularly non-ice hockey pucks. The puck of the invention has a series of runners that engage the play surface, the runners being replaceable and interchangeable by hand, without tools.

Non-ice hockey pucks are typically used on streets or courts, some of which have rough surfaces which can wear down the plastic puck surfaces rather quickly. Eventually the entire puck must be replaced.

It would be desirable to have a puck in which a puck body, the main component and bulk of the puck, is long-lasting and nearly indestructible, but with runner elements that actually contact the playing surface, with these elements of any desired low-friction material, and being relatively inexpensive and easily replaced by hand.

SUMMARY OF THE INVENTION

The current invention achieves this purpose with a puck body of highly durable plastic, the puck body comprising an outer peripheral annulus providing a peripheral striking surface, and a central hub or core and a series of spokes connecting the central hub to the peripheral annulus. The puck body preferably is injection-molded of a hard, durable plastic such as PVC. It can also be formed of TPR (thermo plastic resin), PU (polyurethane), plasticized carbon fiber or vulcanized rubber.

To this puck body are secured a series of removable/replaceable runners, positioned at both opposed surface-engaging sides of the puck. The runners on each side of the puck can provide either a substantially contiguous ring for play surface engagement, or an interrupted series of circumferentially spaced apart runners for less contact area and lower friction with a play surface.

The runners are attached to the puck body in a unique way. Each runner has a glider head that actually contacts the play surface, and a leg curving down from the glider head to extend generally at a right angle to the glider head and gliding surface of the runner. The leg has a distal or inner end adjacent to which is a hook that is positioned to snap over and engage a ledge formed in the inner wall of the peripheral annulus of the puck body. The runner is of integrally molded plastic, such as a hard nylon plastic, and the leg possesses a springing elasticity so as to be capable of deflection when the runner is pushed into position on the peripheral annulus, to the extent that the hook snaps over the ledge and locks the runner in place on the puck body. In a preferred embodiment, replaceable runners are assembled onto both sides of the puck, generally opposite one another and with the legs positioned side by side in openings of the puck body between the spokes. Here, the hooks of the two runner legs latch onto adjacent but oppositely-directed ledges.

Although the runners are securely retained on the puck body and will not release during play, they are easily removed by hand when desired. On the opposite side of the puck from a runner's glider head, the tail end of the leg has a release tooth that can be engaged with a fingernail or with a narrow object such as a ballpoint pen. Engaging this tooth and pressing inwardly toward the hub will quickly release the hook from the ledge causing the runner to be ejected from the puck body.

Preferably the runner includes a positioning shank depending from the underside of the glider head, this shank being positioned to engage in a slot of the peripheral annulus so as to hold the glider head in proper position as the runner is pushed, the leg is deflected and the hook is caused to snap over the ledge.

The invention allows worn or broken runners to be quickly and easily replaced, as well as interchangeability of runners to provide runners of different size or play characteristics. This is easily achieved by hand, without tools. These and other objects, advantages and features of the invention will be apparent from the following description of a preferred embodiment, considered along with the accompanying drawings.

DESCRIPTION OF PREFERRED EMBODIMENTS

Figure 1:
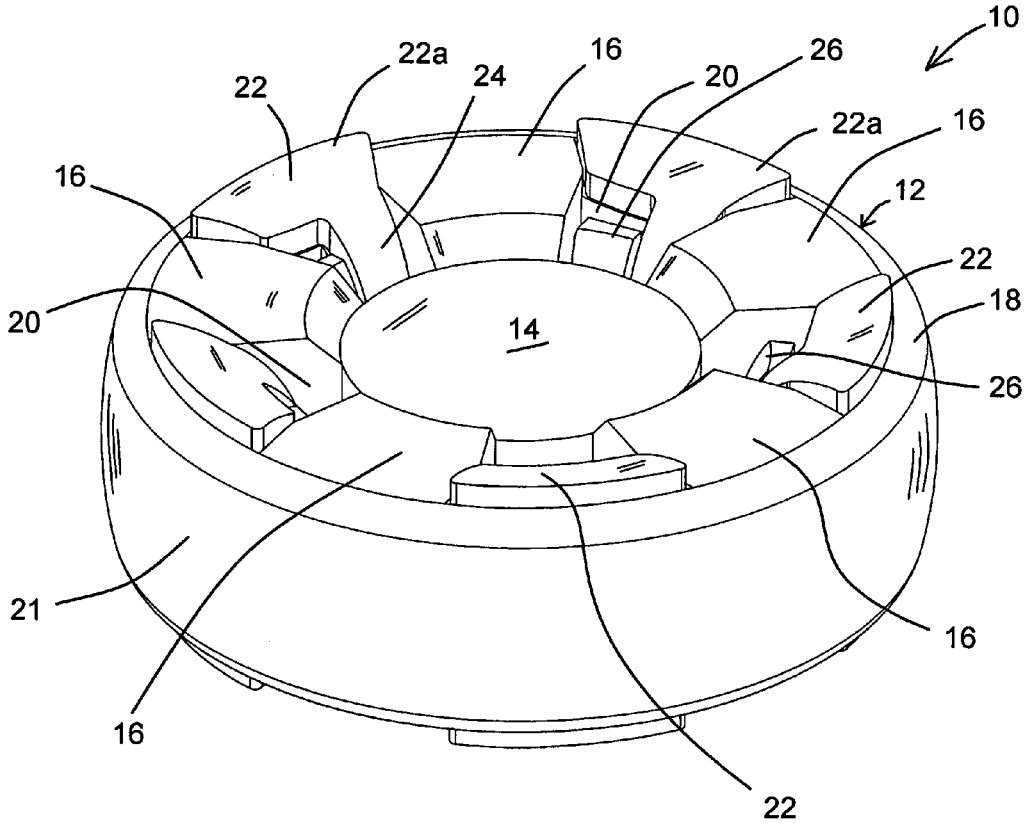
FIG. 1 is a perspective view showing a non-ice game puck in accordance with an embodiment of the invention.

In the drawings, FIG. 1 shows a game puck 10 of the invention, particularly a hockey puck for non-ice surfaces. The puck includes a puck body 12 that is comprised of a center hub or core 14, a plurality of radially-extending spokes 16 (five are shown here) that extend preferably integrally from the hub 14, and a peripheral annulus 18 that is connected, preferably integrally, to the spokes 16. This leaves a series of openings indicated at 20, equal to the number of spokes, an opening being positioned between each pair of adjacent spokes. The outside of the puck body presents a peripheral surface 21, slightly rounded as shown, for striking.

A series of runners 22 are fitted onto the peripheral annulus 18 to present a low-friction surface to engage against the play surface (floor, street, etc.), each runner 22 having a leg 24 extending down into the opening between adjacent spokes. The runners 22 are fitted into the puck body 12 from both sides, and distal or inner or tail ends 26 of some of the runners inserted from the opposite side are seen in FIG. 1.

Figure 2:
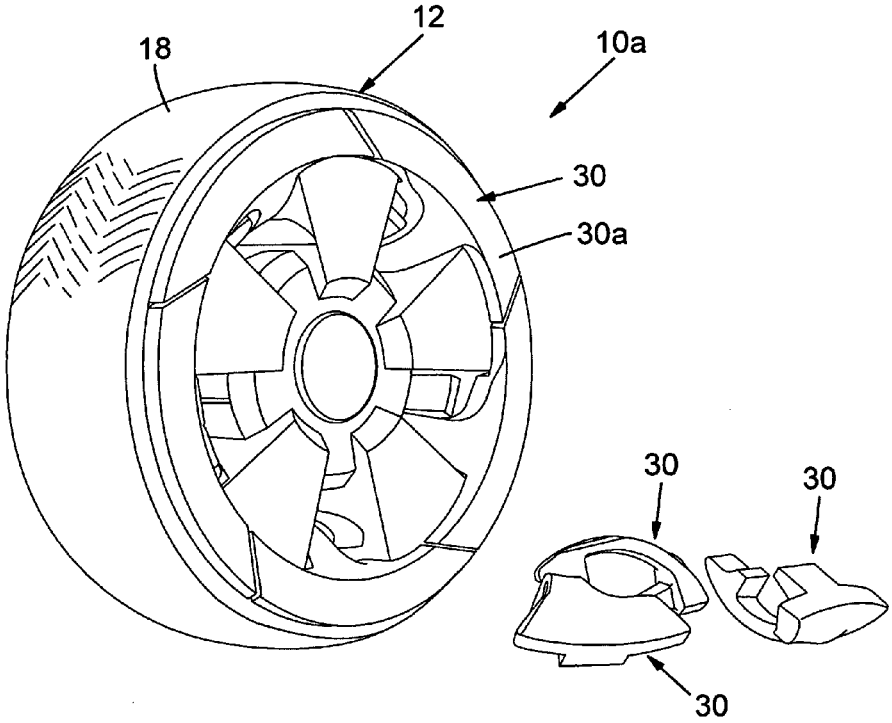
FIG. 2 is a perspective view showing the hockey puck with different runners.

In FIG. 1 the runners 22 have glider heads 22*a* of limited surface area, i.e. limited area for contact with the play surface. These are for smooth surfaces and allow for less friction. FIG. 2, on the other hand, shows a puck 10*a* which has the same puck body 12 but with different runners 30, each having glider heads 30*a* of larger surface area, so that the series of glider heads 30*a* on a side of the puck preferably present a substantially continuous ring as shown. These can be considered training gliders, in that they can be used on coarse surfaces such as streets or concrete and provide a good puck for training, with the runners easily replaced when worn or broken. The hard nylon plastic used in both cases is a low friction material with good wear characteristics. Other plastics could be used.

Figure 5:
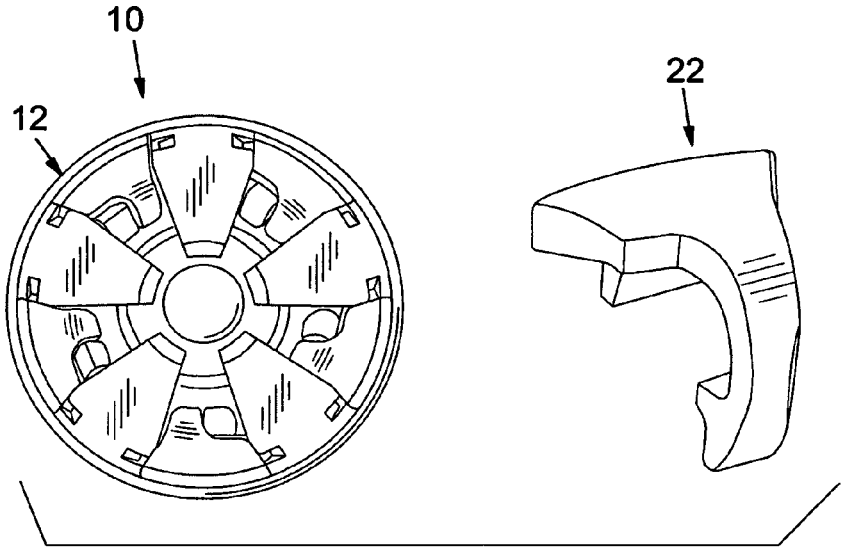
FIGS. 5 and 6 are perspective views indicating a puck body but with different runners assembled into the bodies, forming different glider configurations.
Figure 6:
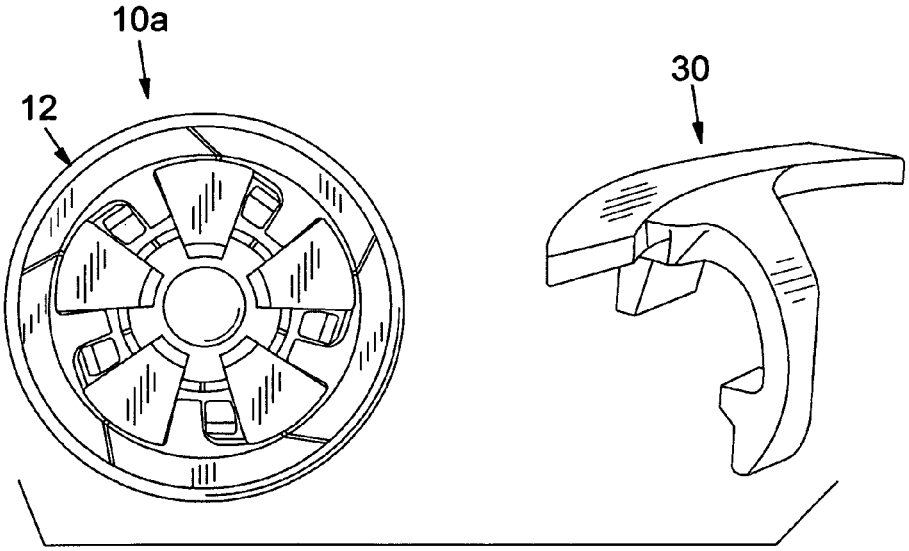

FIGS. 5 and 6 show the pucks 10 and 10*a* of FIGS. 1 and 2, along with the respective runners 22 and 30 used in those pucks, the puck body 12 being the same in both cases.

Figure 3:
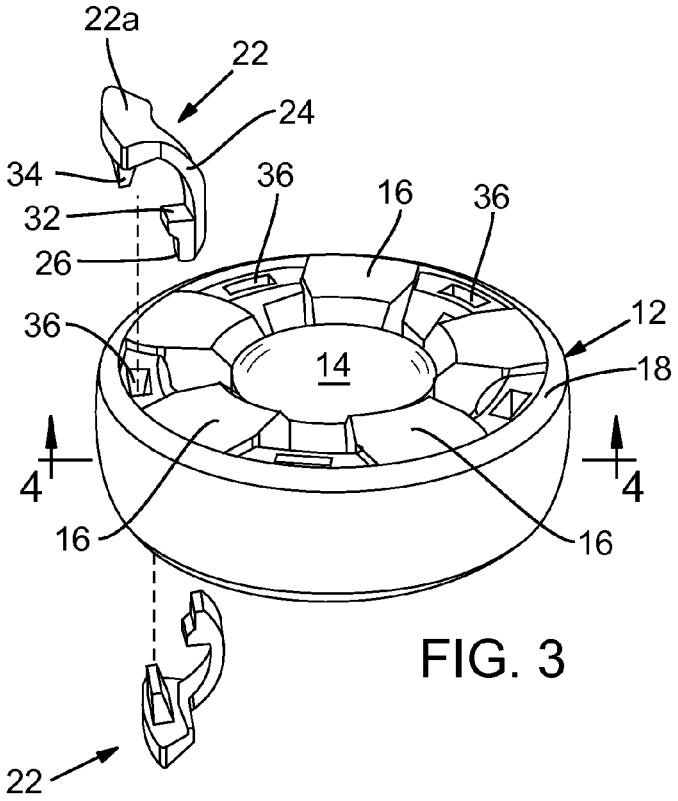
FIG. 3 is a schematic, exploded perspective view indicating assembly of runners into the hockey puck body of the invention.
Figure 4:
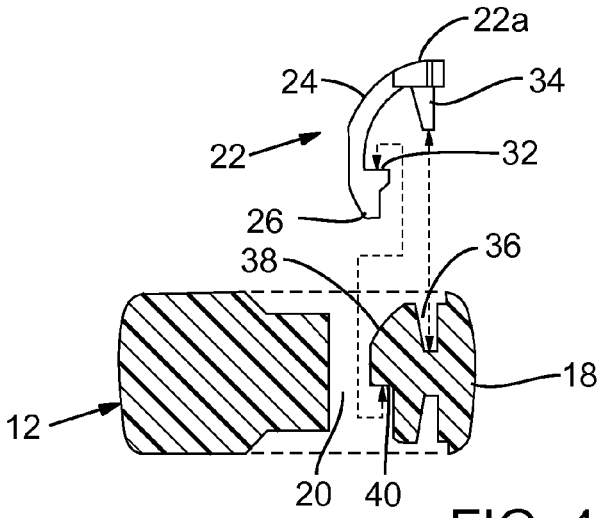
FIG. 4 is a sectional elevation view indicating assembly of a runner into the puck body.

FIGS. 3 and 4, both exploded views, show the configuration of the runners and demonstrate the assembly and securing of runners into the puck body 12. In this case the runners 22 with smaller glider head 22*a* are shown, as in FIG. 1.

Each runner has the glider head 22*a*, a leg 24 extending down from the glider head, preferably on a curve as shown, toward a distal or inner end 26 which, as explained below, also constitutes a finger tab. In addition, the leg has a hook 32 for securing the runner 22 into the puck body. Also preferably included in the integrally, unitarily molded runner 22 is an anchoring shank 34 as seen in the drawings. As indicated in FIG. 3, the runners 22 are inserted from both sides, and in doing so the legs 24 become positioned side by side (but inverted in orientation), and this is illustrated in FIG. 1 where the leg inner or tail ends 26 inserted from the opposite side are visible, each being directly alongside a leg of the runner 22 at the illustrated top side.

The runner body 22, in the peripheral annulus 18, preferably includes a series of slots or cavities 36 as shown in FIGS. 3 and 4, positioned to receive the anchoring shanks 34 of the runners. On assembly of a runner 22 down into the puck body 12, as particularly illustrated in FIG. 4, the anchoring shank 34 (which may be tapered as shown) is engaged into a corresponding slot 36 of the puck body, as the leg 24 is inserted down into the space 20 between spokes. As shown, the leg 24 preferably is shaped essentially complementarily to the corresponding surface of the peripheral annulus, that shape comprising a deflection ramp 38 (preferably curved) which is engaged by a lower or distal end of the leg as the runner is pushed in. With the anchoring shank 34 in the slot 36, further advancement of the runner leg down into the puck body bends and deflects the leg 24 somewhat, until the hook 32 clears a ledge 40 at the bottom end of the deflection ramp, whereupon the hook 32 snaps into place, locking the runner firmly in place on the puck body with the glider head 22*a* against the top of the peripheral annulus as viewed in FIG. 4. Note that the puck body preferably has top/bottom symmetry, with deflection ramps 38 and ledges 40 side by side (and inverted) in each space 20, but FIG. 4 is a sectional view as cut through one of the ledges 40. When all runners 22 have been snapped into both sides of the puck body, the puck 10 appears as in FIG. 1.

When a worn or broken runner is to be removed and replaced, or to interchange the type of runner to be used on a puck body, the finger tab 26 of a runner, i.e. the runner's tail or distal end, is accessible from the side of the puck opposite the runner's glider head. Thus, as can be envisioned from FIG. 1 and also FIG. 4, one can engage the finger tab 26 and deflect it radially inwardly toward the hub or core, thus releasing the hook from the ledge. In lieu of a finger tip, a narrow object such as a pen or pencil can be used. Releasing the hook tends to pop the runner out from the opposite side of the puck body because of the spring action of the runner leg.

Figure 7:
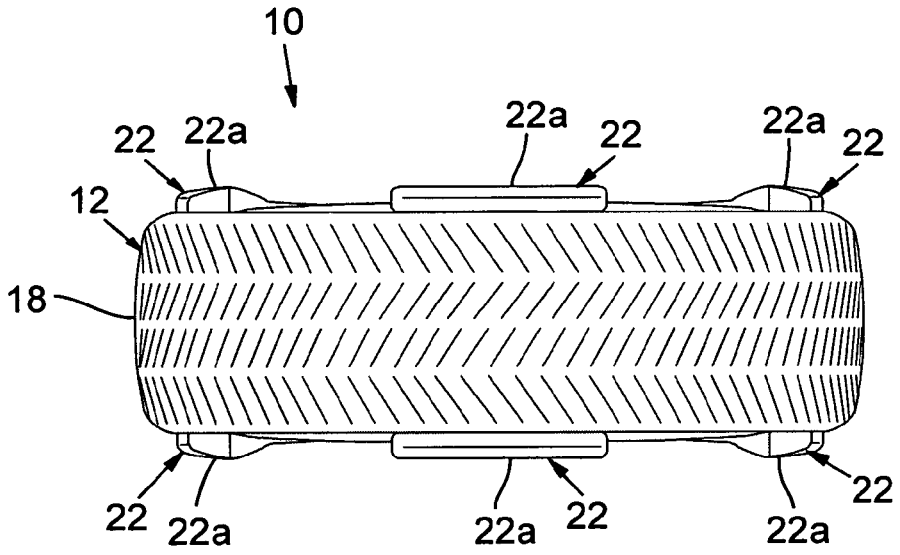
FIG. 7 is a side elevation view showing the assembled puck of FIG. 5.

FIG. 7 is a side view showing the puck 10 of the invention, i.e. the configuration shown in FIG. 1. The glider heads 22*a* of the runners are shown as protruding upwardly (and downwardly) from the peripheral annulus of the puck body, these providing the contact area for engaging with a floor or other play surface.

The puck body and the runners are efficiently made by injection molding. Runners can be of any desired color which can be different from that of the puck body. If desired the puck body can carry a central decorative hub insert (which could be co-molded), and this can match the runner color. The size of the puck is about 3 inches outside diameter (+/−10%), and about 1⅛ inches in height (+/−10%), including the runners, generally the size of a standard puck.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A hockey puck for non-ice use, with replaceable runners, comprising:

a puck body having a peripheral annulus with an outer peripheral surface and having a central core with spokes connecting the central core to the peripheral annulus, a series of friction-reducing runners, secured to each of a top side and a bottom side of the peripheral annulus of the puck body, the runners being positioned to engage a play surface on which the puck is used, with either the top side or the bottom side engaging the play surface, each runner including a glider head for contacting the play surface, a leg extending down from the glider head into an opening between spokes of the puck body, and a hook near a distal end of the leg for engaging over a ledge of the peripheral annulus, the ledge being spaced away from the top and bottom surfaces of the peripheral annulus, the runner being of integrally molded plastic with the leg being elastically bendable such that when the runner leg is pushed down into the puck body the leg deforms to engage the hook over the ledge and snaps the hook into place on the ledge to hold the glider head against the peripheral annulus, and the runner leg having a release tab adjacent to the hook, engageable by a narrow object or a user's finger from a side of the puck opposite that of the glider head, so that the user's finger or a hand-held object can engage the tab, deflect the leg to release the hook and thus to release the runner from the puck body, whereby the runners of the puck can be easily replaced when worn, without use of tools.

2. The hockey puck of claim 1, wherein the peripheral annulus includes, under each glider head, a slot extending down into the annulus, and the runner includes a shank extending down into the slot, such that for assembly of a runner onto the puck body, the shank is inserted into the slot as the leg is pushed down into said opening between spokes, to hold the glider head in position on the peripheral annulus as the leg is fully inserted to allow the hook to snap in place over the ledge.

3. The hockey puck of claim 1, wherein each glider head is shaped as an arc of a circle.

4. The hockey puck of claim 1, further including a second series of friction-reducing runners having a different glider head size and area, the runners being interchangeable so as to change play characteristics of the puck.

5. The hockey puck of claim 1, wherein the puck body includes two said ledges within each said opening between spokes of the puck body, the ledges being oriented in opposite up/down directions, and the runners being configured such that runner legs are inserted from opposite sides of the puck body with the runner legs side by side and engaged on respective oppositely-directed ledges.

6. The hockey puck of claim 1, wherein the runners are injection molded of hard nylon plastic.

7. The hockey puck of claim 1, wherein the puck body is injection molded of PVC plastic.

* * * * *